United States Patent [19]

Bopst, III

[11] 4,419,172

[45] Dec. 6, 1983

[54] ADAPTER FOR AUTOMATIC TAPE LAYING MACHINE

[76] Inventor: John H. Bopst, III, 409 Chalfonte Dr., Baltimore, Md. 21228

[21] Appl. No.: 399,958

[22] Filed: Jul. 19, 1982

Related U.S. Application Data

[63] Continuation-in-part of Ser. No. 307,365, Jan. 1, 1981, Pat. No. 4,373,987.

[51] Int. Cl.[3] ..... B31F 1/00; B44C 7/00; B30B 5/02

[52] U.S. Cl. ..... 156/461; 156/576; 156/577; 156/579; 156/583.1; D8/355; D15/144

[58] Field of Search ..... 156/583.1, 583.9, 577, 156/576, 574, 579, 358, 360, 363, 71, 463, 212, 200, 461, 581; DIG. 8/106, 355; DIG. 15/144

[56] References Cited

U.S. PATENT DOCUMENTS

| | | | |
|---|---|---|---|
| D. 262,291 | 12/1981 | Bopst | D15/144 |
| 451,879 | 5/1891 | McQueney | 156/576 |
| 2,533,209 | 12/1950 | Ames | 156/582 |
| 3,047,047 | 7/1962 | Winberg | 156/583.6 |
| 3,536,569 | 10/1970 | Gosnell | 156/577 |
| 3,813,274 | 5/1974 | Rothenberger | 156/576 |
| 3,829,347 | 8/1974 | Honea | 156/577 |
| 4,174,249 | 11/1979 | Bopst | 156/577 |
| 4,248,659 | 2/1981 | Bopst | 156/574 |
| 4,295,921 | 12/1981 | Bopst | 156/577 |
| 4,358,337 | 11/1982 | Johnson et al. | 156/577 |

*Primary Examiner*—Edward C. Kimlin
*Assistant Examiner*—Louis Falasco
*Attorney, Agent, or Firm*—John F. McClellan, Sr.

[57] ABSTRACT

An improvement for a system employing a heated iron V-shaped soleplate adapter to lay hot-melt tape in a "V" joint between building wall panels includes coacting subsystems for progressively changing the cross-sectional shape of tape fed in at the front end of the system from flat to "V" shaped and for releasibly retaining tape for preventing it from springing out of alignment at the rear end of the system; a special-shape head at the front end is resiliently mounted and a provision at the rear end keeps the tape retaining member out of the way when not in use.

11 Claims, 8 Drawing Figures

ADAPTER FOR AUTOMATIC TAPE LAYING MACHINE

This application is a continuation-in-part of my Application Ser. No. 307,365 filed Jan. 1, 1981, now U.S. Pat. No. 4,373,987 for Angle-Attachment Stabilizing Unit.

FIELD OF THE INVENTION

This invention relates generally to tape laying machines and specifically to an adapter facilitating laying tape at wall intersections and at overhead corners.

In the prior art various disclosures have been made concerning tape laying including those in my U.S. Pat. No. 4,174,249 issued Nov. 13, 1979, for System for Instantaneous Sealing of Cracked Lines in Plaster; my U.S. Pat. No. 4,248,659 issued Feb. 3, 1981 for Angular Attachment for Instantaneous Sealing of Cracks; my U.S. Pat. No. 4,295,921 issued Oct. 20, 1981 for System for Controlling the Movement And Locking of Tape Apparatus; my U.S. Pat. No. D. 262,291 issued Dec. 15, 1981 for Crack Sealer and my U.S. Pat. No. 4,330,355 issued May 18, 1982 for System for Controlled and Immediate Sealing of Structural Joints and Plaster Line Cracks.

However, because visual and physical access beneath the tape laying machine may be limited in starting a run up a wall-intersection joint, and may be limited at the end of a run where the ceiling meets the corner, using known machines, tape laying may require considerable skill and experience to do properly, increasing costs.

SUMMARY OF THE INVENTION

Principal objects, therefore, are to provide a system in this invention which will sharply reduce the skill and experience required to apply hot melt tape to wall-intersection joints, and will, at the same time, produce better appearance and more consistent results. Heat reactivated tape will also be usable with this invention.

Further objects are to provide a system as described in which advantages sought are provided through accessory structure including new quickly detachable soleplate carrying at the front end a resiliently yielding corner guide for tape and coacting at the rear with a quick-gripping tape free-end holder to keep the tape free end in desired position until tape laying begins and then to release and retract out of the way manually or automatically.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
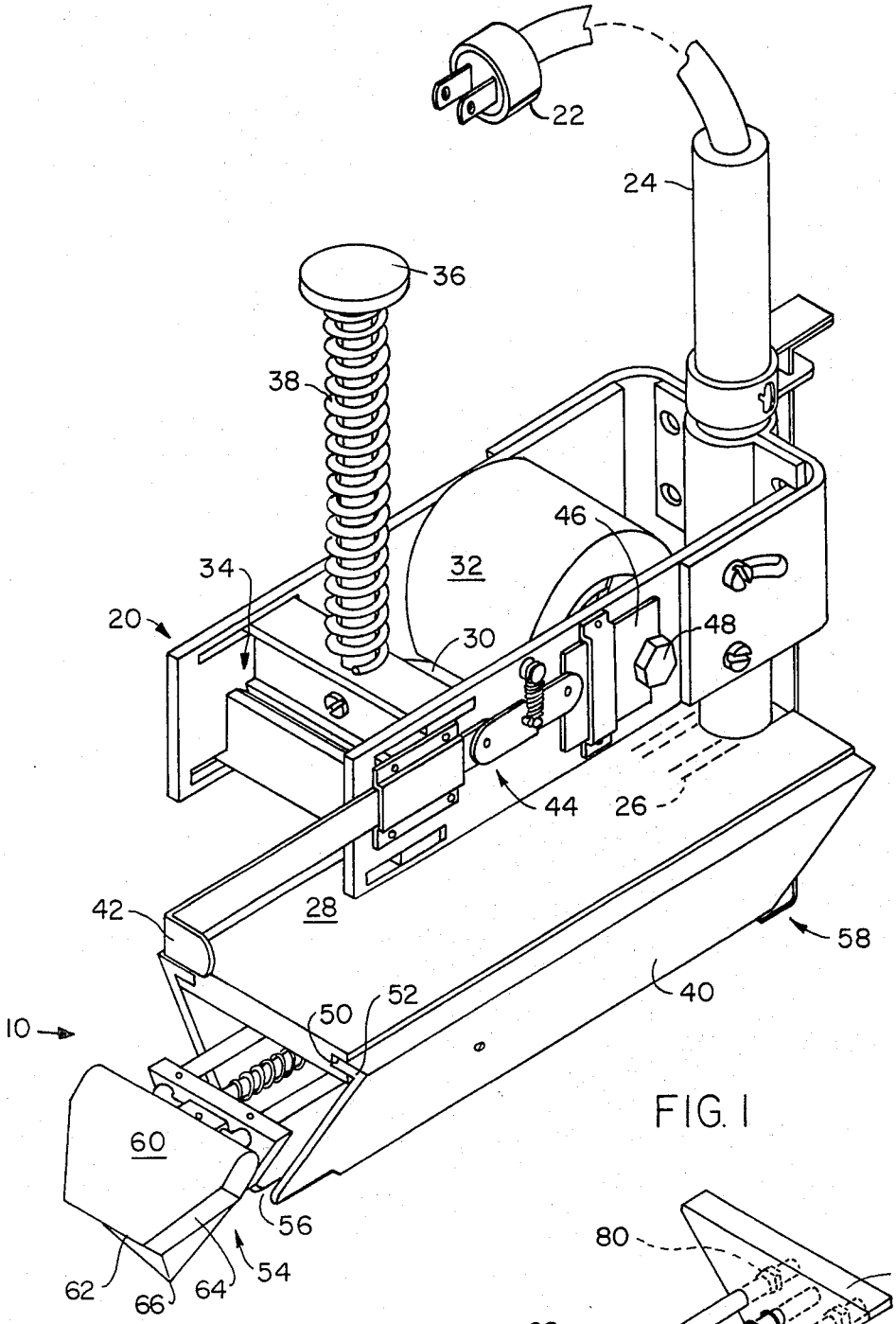
FIG. 1 is an overall perspective view of a system including some known art, equipped with this invention.

FIG. 1 shows the invention 10 installed on manual advance apparatus 20 generally like that of my said U.S. Pat. No. 4,330,355.

Generally, the portions of the appartus for which the invention is an appliance, and in some details modifies parts, include electric connection 22 running through handle 24 to supply a heater 26 (fragmentarily represented) in a soleplate 28 (similar to the one shown but without certain modifications to be described) to heat tape 30 when led forward from a roll of tape 32 through a guillotine type cutter 34 (which is actuated manually by a handle 36 with a spring 38 to bias the cutter open) and down and around to the rear past a simple "V"-shaped soleplate adapter 40 (similar to the one shown but without certain modifications to be described). When trigger 42 strikes a ceiling (or a floor) it causes linkage 44 to move a wrench plate 46 to the rear, locking the spool at hexagonal axle-termination 48. When the spool is locked like this, just enough tape length lies ahead of the cutter to finish the joint to the end at the ceiling (or floor as the case may be, or, if horizontally travelling, a wall.)

THE INVENTION

Still in reference to FIG. 1, the invention 10 may include modification to the soleplate 28 in the form of a longitudinal slot 50 in each side of the soleplate. Each slot 50 carries in a tight friction fit an inturned edge 52 of the "V"-section soleplate adapter 40 (which is shaped to hot-press tape into a 90° angle between wall panels) so that the "V"-section soleplate adapter can be quickly attached or detached carrying with it the new front-end tape guide assembly 54, shown. The "V"-section soleplate adapter 40 may have a slot 56 at the apex of the "V" in the front end to receive a part of the front-end tape guide assembly in one position.

The front-end tape guide assembly 54 is in essence a sprung adjustable-angle head to conform tape around the front end of the assembly to desired configuration, progressively changing tape cross-sectional shape from flat to "V" as the tape passes down around and rearwardly of the shaping mechanism. This is described in more detail in later Figures.

Parts of a tape free-end holder assembly 58 are visible at the rear, and this also will be explained in reference to later Figures.

Figure 2:
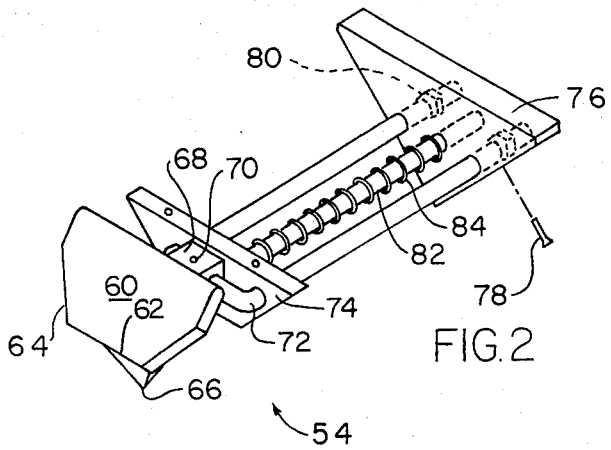
FIG. 2 is a perspective detail of a front end portion of the invention visible in part in FIG. 1.
Figure 3A:
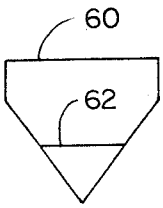
FIG. 3*a* is a front elevational detail thereof.
Figure 3B:
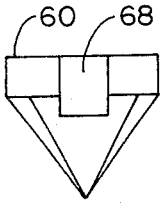
FIG. 3*b* is a rear elevational detail thereof.

FIGS. 2, 3*a* and 3*b* show further details of the front-end tape guide assembly 54. Head 60 has in front a transverse horizontal ledge 62 with diagonal bevels 64 at the lower sides symmetrically merging into a "V"-shaped keel 66, all proportioned to fit back into the "V"-section soleplate adapter when forced back by contact with a ceiling (or floor as the case may be, or another wall, if travelling horizontally.)

Angle-adjustment for the head 60 is provided by a block 68 integral with it which by means of a set-screw 70 fixes the angular relation to a transverse portion of a rod 72 passing through the block. On each side, as sliding guides, the rod 72 turns back in longitudinally parallel lengths fixed to and passing through a first plate 74 slidable within the "V"-section soleplate adapter 40 and through a second plate 76 fixed to the adapter as by a screw 78. Nuts 80 keep the rods from passing forwardly out of the second plate 76.

A central rod 82 fixed to the first plate 74 extends back through the second plate 76 and carries between the two plates a compression spring 84 which biases the head forwardly at all times.

Figure 4:
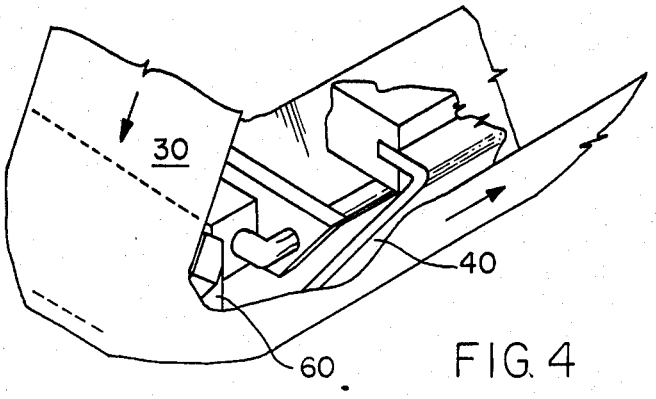
FIG. 4 is a perspective fragmentary detail of a front-end portion shown in FIG. 1 but with tape being guided by it.

FIG. 4 shows how the head 60 receives tape 30, which as it passes (in the arrow direction) the head 60 gradually re-shapes from flat into a "V" conforming to the bottom shape of the "V"-section soleplate adapter 40.

Figure 5:
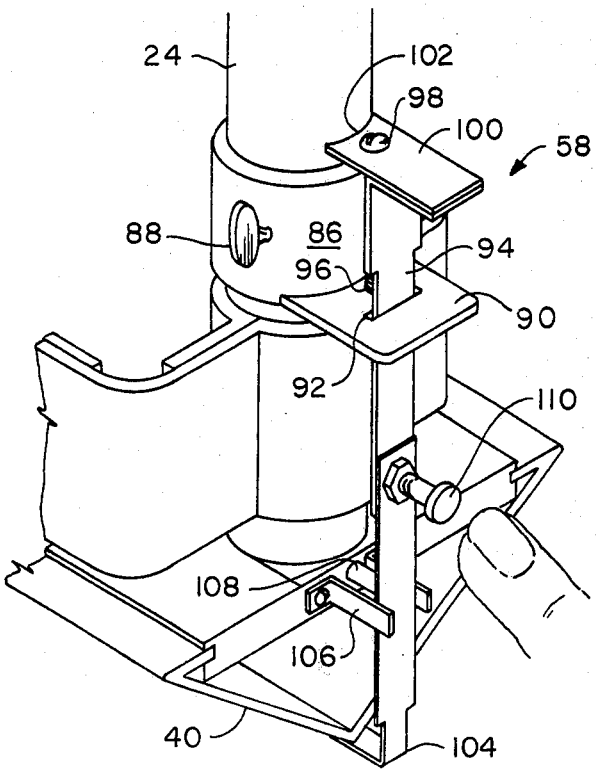
FIG. 5 is a perspective detail of a rear quarter portion of the FIG. 1 showing.
Figure 6:
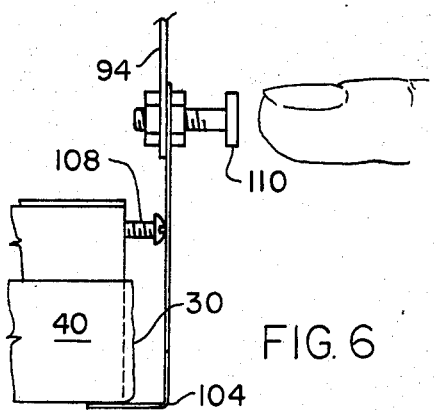
FIG. 6 is an elevational fragmentary detail of a part of the FIG. 5 showing.
Figure 7:
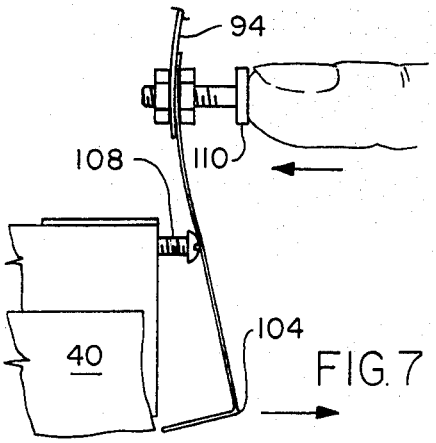
FIG. 7 is an elevational view showing the FIG. 6 mechanism in a second position of operation.

FIGS. 5, 6 and 7 are now referred to together.

FIG. 5 shows the co-acting rear assembly 58 of the invention. The tape is somewhat resilient. When the tape is passed around the head at the front end and changes shape it tends, before tape laying begins but in preparation for it, to spring the free end of the tape away from "V"-shaped soleplate adapter 40, making it harder to begin taping with the tape properly aligned with the machine. Tape-holder mechanism 58 solves the problem of holding the tape free end prior to taping, and springs free of the work area when not needed.

It comprises a sleeve 86, adjustably positionable on the handle 24 by means of a set screw 88, and supporting rearwardly of the handle a horizontal flange 90 with a slot 92 through which passes a flexible strip or plunger 94 biased upwardly by a compression spring 96 between the plate 90 and a screw 98 in a grip 100 at the top of the plunger; the grip may have a recess 102 guiding on the handle 24.

A lower part of the plunger 94 is in the shape of an "L" 104 and may be sprung to extend under a free-end of the tape 30 along the lower rear end of the "V"-section soleplate adapter 40 and hold the tape to it. Lateral guides 106 on the soleplate 40 may hold the plunger from shifting to the side, and between them a fulcrum screw 108 may extend rearwardly from the soleplate.

When the midpoint of the flexible plunger is deflected towards the front, by pressing a handle 110 which may be provided above the fulcrum screw for the purpose, the lower end "L" 104 pivots about the fulcrum screw and lifts free of the tape and "V"-section soleplate adapter and rises above them to a point clear of the apex and sides of the "V", where it hangs on the rear end of the "V"-section soleplate with the free end of the "L" against it.

Being upwardly sprung in this manner the "L" can also automatically do the same thing when commencement of tape laying pushes it to the rear. The sleeve can be set in position up and down the handle to adjust the springing action of the "L" portion and the fulcrum screw can be adjusted in or out to produce the desired overlap at the bottom.

This invention is not to be construed as limited to the particular forms disclosed herein, since these are to be regarded as illustrative rather than restrictive. It is, therefore, to be understood that the invention may be practiced within the scope of the claims otherwise than as specifically described.

Further, sleeve 86 can be moved upward and held in position by screw 88 to allow tape-holder 58 to hold the tape on soleplate 28 with "L" 104 when "V"-shaped soleplate adapter 40 is removed; tape can then be applied over a flat wall joint.

What is claimed and desired to be protected by United States Letters Patent is:

1. In a system for heating and laying tape in a "V" joint formed by intersecting wall panels upon manual advance of said system therealong, the system having a source of flat tape for running tape over a forward end and down and toward the rear end of a "V"-shaped soleplate adapter, the improvement comprising: means including a head for progressively changing the cross-sectional shape of tape from flat to "V"-shape at said forward end, means resiliently mounting and forwardly biasing said means for progressively changing, and means for holding said tape in alignment with said "V"-shaped soleplate adapter at said rear end in preparation for said tape laying.

2. In a system as recited in claim 1, said means for progressively changing including said head having a horizontal portion above a "V"-shaped keel.

3. In a system as recited in claim 1, said means for holding having an "L"-shaped portion located for releasibly retaining a free end of tape against said "V" shaped soleplate adapter at a bottom rear portion of said "V"-shaped soleplate adapter.

4. In a system as recited in claim 3, means for keeping said "L" shaped portion free of said tape when released from retaining said tape, including means biasing said "L" shaped portion upwardly.

5. In a system as recited in claim 4, means for releasing said "L" shaped portion from retaining tape, comprising a fulcrum, and a location for pressing and springing said "L" shaped portion about said fulcrum.

6. In a system as recited in claim 3, means for angularly adjusting said head.

7. In a system as recited in claim 6, said head having proportion for retracting into said "V"-shaped soleplate adapter.

8. In a system as recited in claim 3, and means for adjusting said retaining.

9. In a system as recited in claim 8, the adjusting means including means for raising and lowering said "L" shaped portion.

10. In a system as recited in claim 1 means mounting said head to said "V"-shaped soleplate adapter.

11. In a system as recited in claim 1, a soleplate holding said "V"-shaped soleplate adapter, a handle on said soleplate, means for removing said "V"-shaped soleplate adapter, and means for releasibly retaining a free end of tape against said soleplate when said soleplate adapter is removed, including means slidably adjustable on said handle.

* * * * *